United States Patent [19]

Kolbinger et al.

[11] 4,010,672

[45] Mar. 8, 1977

[54] DRIVING MECHANISM FOR THE COVER OF AN AMMUNITION MAGAZINE ON ARMORED LAND VEHICLES

[75] Inventors: Hans Kolbinger, Hofolding; Ulf Wossagk, Taufkirchen, both of Germany

[73] Assignee: Messerschmitt-Bolkow-Blohm GmbH, Munich, Germany

[22] Filed: Nov. 4, 1975

[21] Appl. No.: 628,771

[30] Foreign Application Priority Data

Nov. 28, 1974 Germany ..... 2456186

[52] U.S. Cl. ..... 89/1.802; 89/1.815

[51] Int. Cl.[2] ..... F41F 9/06

[58] Field of Search ..... 89/1.802, 1.803, 1.804, 89/1.8, 1.815, 36 H, 40 B; 292/201, 259

[56] References Cited

UNITED STATES PATENTS

| | | | |
|---|---|---|---|
| 3,180,224 | 4/1965 | Linke | 89/1.801 |
| 3,316,808 | 5/1967 | Mais | 89/1.804 |
| 3,800,659 | 6/1972 | Kuiper | 89/1.802 X |
| 3,946,640 | 3/1976 | Baumann | 89/1.815 |

FOREIGN PATENTS OR APPLICATIONS

| | | | |
|---|---|---|---|
| 2,057,065 | 5/1971 | Germany | 89/1.802 |

*Primary Examiner*—David H. Brown
*Attorney, Agent, or Firm*—Toren, McGeady and Stanger

[57] ABSTRACT

A driving mechanism for controllably opening and closing the cover of an ammunition storage magazine of an armored land vehicle operates to enable the cover to be opened in an essentially vertical position by automatic hydraulic means when the ammunition, which may comprise rockets or the like, is to be loaded into a launcher located above the magazine. When it is desired to reload the magazine itself, the cover may be detached from the driving mechanism and manually opened into a horizontal position extending generally flush with the opening of the magazine itself to facilitate loading of ammunition into the magazine.

7 Claims, 4 Drawing Figures

DRIVING MECHANISM FOR THE COVER OF AN AMMUNITION MAGAZINE ON ARMORED LAND VEHICLES

BACKGROUND OF THE INVENTION

The present invention relates generally to armored land vehicles such as tanks and the like, and more particularly to portions of ammunition storage magazines for such tanks. The tanks or armored land vehicles may be of the type armed with rockets or missiles and including launching means for such armament. More specifically, the invention is directed to a driving mechanism for the covers of the ammunition storage magazines of the armored land vehicle whereby loading of a rocket launcher from the magazine, and charging of the magazine itself may be facilitated by enabling appropriate positioning of the cover thereof.

The invention concerns a driving mechanism for the cover of the magazine of an armored land vehicle which is particularly suited to receive jet powered rockets or missiles which are launched either without a launching tube or from a launching tube of a launching device which is vertically controllable as to height and which may be automatically moved by means of a conveyor device under the influence of a followup control from the magazine to the launching device and be locked with the latter.

In prior art magazines of this type, for example, magazines which are disclosed in German utility Pat. (Gebrauchsmuster) No. 6,608,819, the magazine cover must be opened by movement through an angle of 90° in order to obtain, on the one hand, rapid opening of the magazine to enable high firing rates, and on the other hand, to provide for utilization of gear parts which are sufficiently rugged for battlefield operation and as small and maintenance-free as possible. A further consideration in devices of this type is the fact that space in armored land vehicles is extremely limited so that the drive mechanisms which are utilized must be as compact as possible in order to enable sufficient space utilization.

Rotation of the magazine cover through an angle of 90° into a vertical position to open the magazine is usually adequate to enable the respective launching devices to be armed with ammunition from the magazines, but it presents a considerable obstacle when it is necessary to recharge the magazines with ammunition. With the cover in a vertical position, the ammunition must be lifted to a higher elevation in order to be brought over the height of the cover and into the magazine itself. This is difficult to achieve in the battlefield, particularly when no lifting gears are utilized. Furthermore, the vertical position of the cover blocks the view into the magazine so that the introduction of individual missiles into their respective receptacles becomes more difficult. Additionally, the vertically oriented cover presents an obstacle which can be a serious cause of injury.

Accordingly, the present invention is directed toward the provision of a driving mechanism for the cover of an ammunition magazine of the aforementioned type which permits movement of the magazine through an angle of 90° into a vertical opened position for loading the launching device with ammunition from the magazine while also enabling movement of the cover through 180° into a horizontal position substantially flush with the magazine opening when charging of the magazine with missiles is to be effected. Furthermore, the invention provides a mechanism whereby the magazine parts may be maintained safely in a position within the magazine during travel of the vehicle over terrain.

SUMMARY OF THE INVENTION

Briefly, the present invention may be described as a driving mechanism for the cover of a rocket magazine of an armored land vehicle including a launching device for the rockets, means for loading the rockets into the launching device from the magazine, and means pivotally mounting the cover upon the vehicle. The driving mechanism specifically comprises hydraulic driving means for pivotally driving the cover through an angle of about 90° between a generally horizontal closed position and a generally vertical open position to open the magazine for permitting loading of the rockets from the magazine into the launching device. A mechanical locking device is provided for releaseably locking the cover with the hydraulic driving device for enabling driving engagement therebetween, said locking device being releaseable to enable disengagement between the cover and the hydraulic driving means to permit manual pivotal movement of the cover through 180° to open the magazine for loading or recharging of the magazine with rockets. The locking device includes means for blocking movement of the hydraulic driving means when the locking device is released and the hydraulic driving means are disengaged from the cover.

The hydraulic driving means include a hydraulic cylinder and piston pivotally mounted within the magazine and operating to engage a toggle joint affixed to a locking plate which may be engaged and disengaged from the cover of the magazine. By operation of the hydraulic drive means with the cover locked to the fixing plate, the cover may be rotated through an angle of 90° into a vertical position for opening the magazine.

The locking device includes a slide member which may be moved by means of an eccentric screw device between a first position wherein the cover is locked to the fixing plate and a second position disengaging the cover from the fixing plate. With the cover disengaged from the fixing plate, the cover may be manually moved through the angle of 180° into a horizontal position generally flush with the upper opening of the magazine. The slide member includes a blocking plate which engages the toggle joint when the cover is disengaged from the locking plate to prevent movement of the toggle joint and thereby prevent movement of the hydraulic drive means should accidental actuation thereof occur.

A spring member operates to extend between the slide member and the toggle joint to hold the slide member in a position locking the cover with the locking plate while also biasing the toggle joint in a direction tending to close the cover.

In accordance with the present invention, the cover may be locked with the hydraulic driving means through the detachable mechanical locking mechanism and it may be opened by movement through an angle of 90° by the hydraulic drive means for loading ammunition into the respective launching device from the magazine. When the locking mechanism is unlocked, the cover may be manually moved through an angle of 180° thereby enabling recharging of the magazine while the blocking element of the slide member forms a safety latch for the hydraulic driving means.

The hydraulic drive means consists of a pair of synchronously controlled lifting cylinders having piston rods which are pivotally connected through lever assemblies with locking plates located on the front sides of the cover, both having locking elements for locking the locking plate with the cover.

According to a preferred embodiment of the invention, the lever assembly comprises a toggle joint device connected to a reversing lever which is driven by the lifting cylinder of the hydraulic drive means. The toggle joint assembly is held in a position locking the cover in place by a spring.

In accordance with another feature of the invention, the locking elements for locking the locking plates together with the cover are designed as slides mounted for reciprocating movement by means of an eccentric screw device, with the slides each having a catch or latch member adapted to engage a cooperating latch member on the cover. The blocking plate is provided on the slide on the side thereof remote from the latch means in order that the blocking plate will block movement of the toggle joint when the slide is in the released position.

The spring which is provided is preferably arranged between the slide and a locking element of the toggle joint in order to also act as a locking element.

The cover is pivotally mounted upon the vehicle by means of a fulcrum which is arranged in such a position on the outer walls of the vehicle that the cover will be at approximately the same level as the top edge of the magazine when the cover is opened and rotated through an angle of 180°.

The arrangement of the drive mechanism of the present invention provides a significant advantage in that it insures a reliable and firm locking action for the cover even under severe vibrations of the vehicle because of the design of the locking elements as spring loaded toggle joint levers. The detachable connection between the driving mechanism and the cover permits the cover to be rotated into the horizontal position through 180° despite the fact that the hydraulic system need operate through short actuating distances in shorter periods of time. Thus, the cover may serve as a working platform during charging of the magazine. The introduction of heavy missiles or rockets into the magazine is thus considerably facilitated and since the locking device between the locking plates and the cover also acts as a blocking element for the hydraulic driving gear when the cover is detached from the driving mechanism, the risk of accidents by accidental starting of the hydraulic drive means is virtually eliminated. The division of the driving mechanism into a pair of synchronously operated toggle lever assemblies arranged near the front side of the cover requires little space and avoids blocking of the magazine by the driving mechanism.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
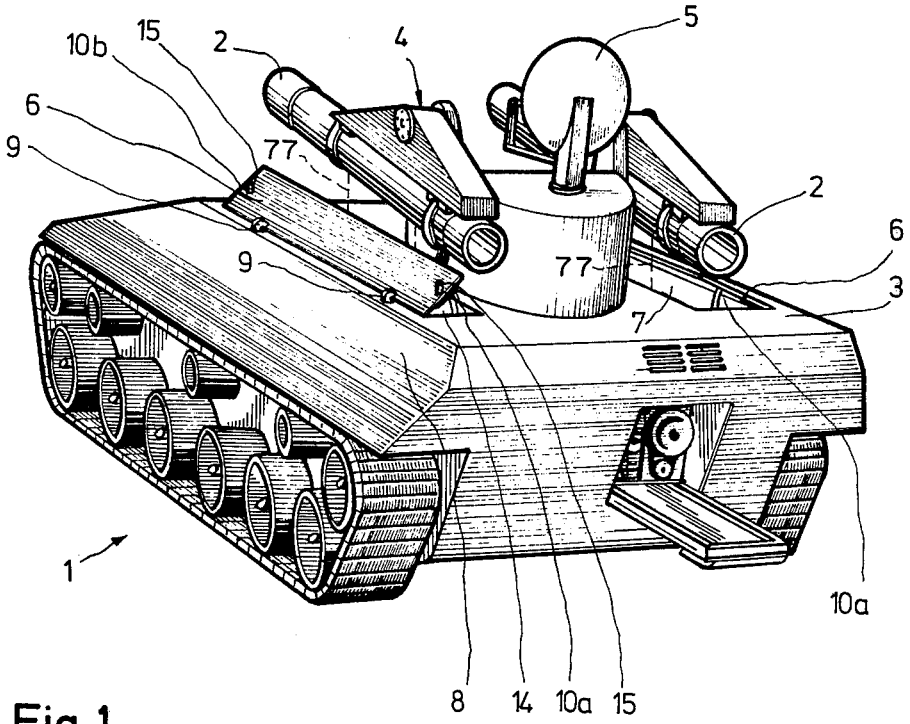
FIG. 1 is a perspective view of an armored land vehicle having parallel magazines arranged on either side thereof and adapted to receive ammunition such as rockets or missiles, the present invention being utilized in such armored land vehicle.

Referring now to the drawings, wherein like reference numerals are used to refer to similar parts throughout the various figures thereof, an armored land vehicle 1 has on its upper side 3 an elevating and traversing launching device 4 for launching projectiles such as jet powered rockets or missiles (not shown) including launching tubes 2. The vehicle depicted in FIG. 1 includes a radar system 5 arranged on the tower of the vehicle with the tower being rotable in a known manner about its vertical axis to produce the traversing movement of the launching devices. On both sides of the tower there are arranged a pair of magazines 7 extending in a longitudinal direction forwardly and rearwardly of the vehicle and adapted to be closed by a cover 6. The magazine 7 receives the rockets or missiles to be launched by the launching device. Means are provided for loading the ammunition, such as the projectiles or missiles including the launching tubes 2, from the magazine 7 onto the launching device 4. Such means may comprise loading devices 77, indicated schematically in FIG. 1, which may be in accordance with prior art structures such as those disclosed in U.S. Pat. No. 3,316,808.

Each of the covers 6 is mounted upon an outer wall 8 of the vehicle 1 by means of pivoted bearings 9 which enable pivoted movement of the covers 6. Each of the covers 6 is adapted to be engaged by a pair of hydraulic driving mechanisms **10*a* and 10*b* located on opposite ends of the magazines 7**.

Figure 2:
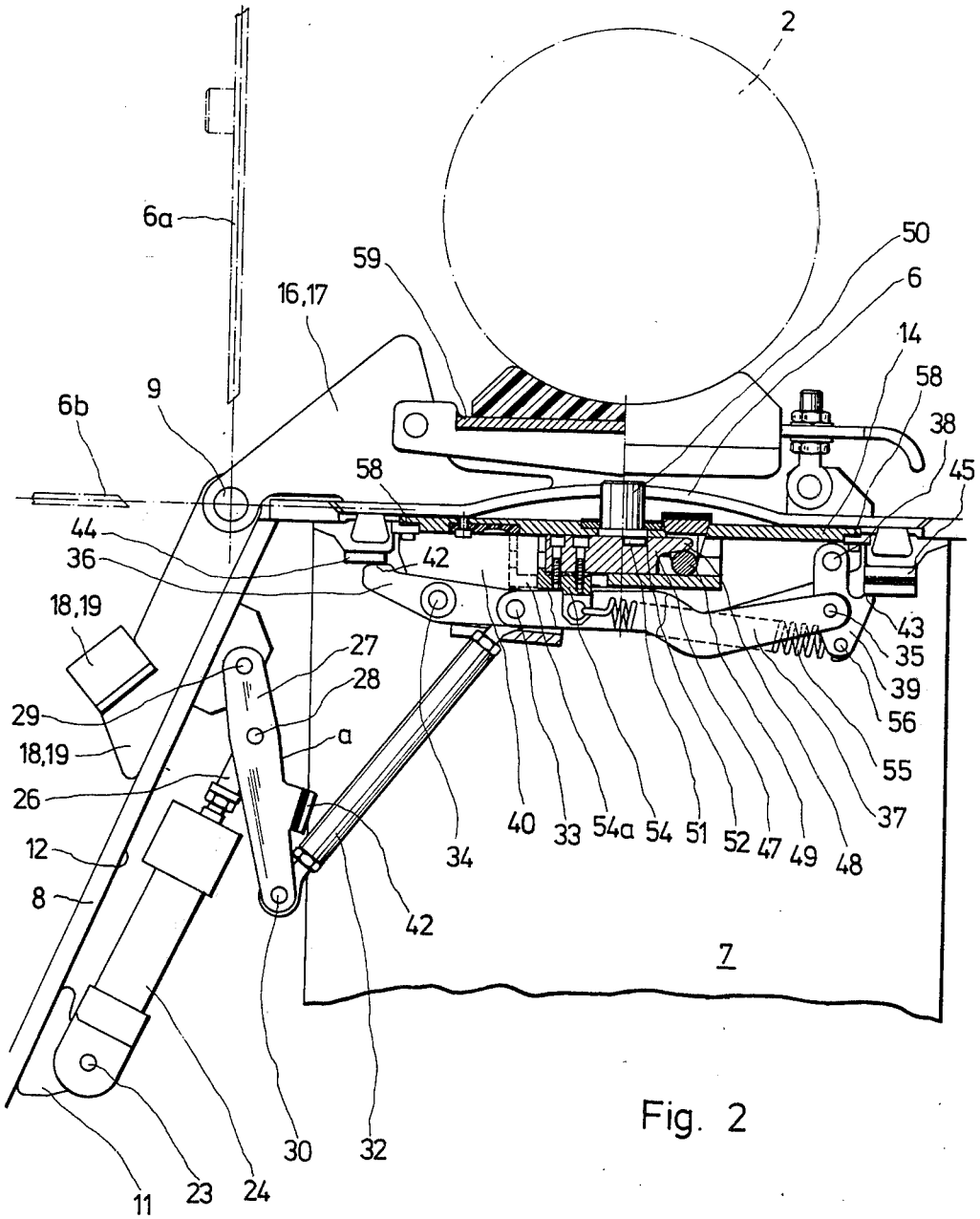
FIG. 2 is a side elevation of the driving mechanism according to the present invention utilized in the upper part of the magazines with a cover articulated to the outer wall of the vehicle shown in FIG. 1.
Figure 4:
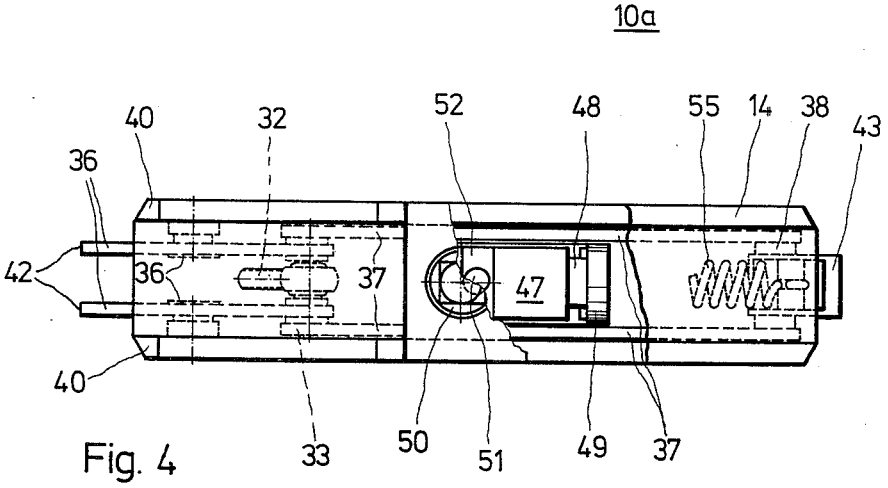
FIG. 4 is a top view of a blocking plate of the driving mechanism depicted in FIGS. 2 and 3.
Figure 3:
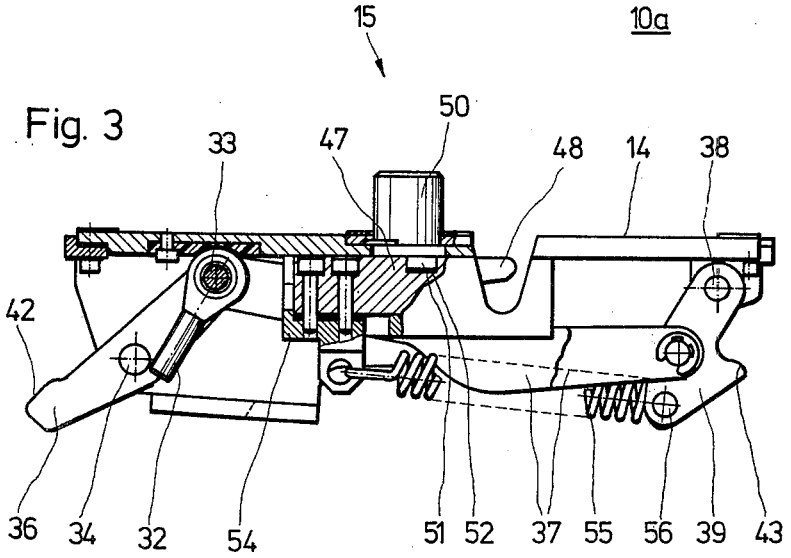
FIG. 3 shows a side elevation of the driving mechanism for the cover.

The driving mechanisms **10*a* and 10*b* are generally identical in structure and operation and, by way of example, the driving mechanism 10*a* is depicted in FIGS. 2, 3 and 4**.

Each of the driving mechanisms include a bearing plate 11 located on the inner wall 12 of a magazine of the vehicle. Each driving mechanism includes a hydraulic lifting cylinder 24 pivotally connected to the bearing plate 11 by a pivot joint 23 with a piston rod 26 extending from the lifting cylinder 24 being articulated with a pivotal connection 28 upon a reversing lever 27. The reversing lever 27 includes a pair of pivotal connections 29 and 30 at opposite ends thereof, with the pivot joint 28 being unequally spaced from the pivotal connection 29 and 30. The reversing lever 27 may be rotated about the pivot joint 29 which is also connected to the inner wall 12 of the magazine. A coupling rod 32 is articulated with the reversing lever 27 at the pivot joint 30. The coupling rod 32 is connected at its opposite end to a toggle lever joint 33 of a toggle joint which includes a toggle lever 36 having a pivotal connection 34, a toggle lever 37 and a locking lever 39. The locking lever 39 is pivotally mounted at 38 and is attached by a pivotal connection 35 to the toggle lever 37.

The driving mechanism of the present invention includes a locking plate 14 arranged beneath the cover 6 and detachably connected thereto by a locking mechanism 15. Each of the covers 6 includes a pair of abutment members 16 and 17 extending from the pivotal bearings 9 and adapted to engage outer supports 18 and 19, arranged on the outer wall of the vehicle, when the cover 6 is completely opened by rotation thereof through an angle of 180° into a substantially horizontal position as depicted at **6*b* in FIG. 2. The cover may be also rotated through an angle of 90° to a position labelled 6*a* in FIG. 2,** in a manner to be more fully described hereinafter.

The pivotal connections 34 and 38 are attached to traversing members 40 fixed to the locking plate 14. The toggle level 36 and the locking lever 39 respectively include projections 42 and 43 arranged to respectively engage abutments 44 and 45 which are secured within the magazines 7 on the chassis of the vehicle.

The cover 6 may be locked in engagement with the locking plate 14 by operation of the locking device 15. Operation of the locking device will also enable the cover 6 to be disengaged from the locking plate 14. The locking mechanism 15 includes a slide 47 mounted upon the locking plate 14 for reciprocal movement, as shown in FIG. 3. The slide 47 includes a protuberance 48 which is adapted to extend over and into locking engagement with a locking pin 49 rigidly connected with the cover 6. The locking pin 49 operates as latch means which may be engaged by the protuberance 48 in order to lock the cover 6 with the plate 14. In this manner, the locking plate 14 is mechanically clamped or latched together with the cover 6.

An eccentric screw device 50, including an extension 51 engaging a groove 52 is adapted to move the slide 47 in a reciprocal fashion leftwardly or rightwardly as seen in FIG. 2. By manipulation of the eccentric screw device 50, the slide 47 may be moved to the right, as viewed in FIG. 2, into a position where the protuberance 48 engages the locking pin 49 in order to lock the cover 6 to the locking plate 14. Operation of the eccentric screw device 50 to move the slide 47 leftwardly, as viewed in FIG. 2, will cause the cover 6 to be disengaged from the locking plate 14 by disengagement of the protuberance 48 from the pin 49.

Arranged upon the slide 47 there is a blocking plate 54 having one end of a spring 55 attached thereto. The spring 55 has its opposite end connected to a pin 56 of the locking lever 39. The arrangement is such that the spring extends between the locking lever 39 and the slide 47 to maintain the slide 47 in locking position with the protuberance 48 engaged over the locking pin 49. At the same time, the spring 55 maintains the toggle joint including the toggle lever 36 and 37 in a position tending to maintain the locking plate 14 and the cover 6 in the closed position represented in FIG. 2.

This closed or locking position of the toggle joint is effected due to the fact that the toggle lever joint 33 is arranged to be located below a line connecting the pivot joints 34 and 38 of the toggle lever 36 and the locking lever 39, respectively. Thus, with the toggle lever joint 33 located below its dead center position, the spring 55 will tend to move the joint 33 downwardly, as viewed in FIG. 2, so that if the hydraulic driving system of the present invention should fail, the toggle joint will be held in its locked position with the cover closed.

If the slide 47 is moved to the left, as viewed in FIG. 2, by actuation of the eccentric screw device 50, the protuberance 48 will become disengaged from the locking pin 49 thereby releasing the cover 6 from the locking plate 14. At the same time, the blocking plate 54 will be moved directly over the toggle lever joint 33 into a position identified as **54*a*. In this position, the blocking plate 54 will prevent the toggle lever joint 33 from being moved upwardly, as viewed in FIG. 2, and the toggle joint will thus be locked in the position depicted in FIG. 2.**

Between the cover 6 and the upper front side of the magazine wall there are provided packings 58 in order to protect the interior of the magazine, wherein the rockets or missiles are to be received, against water or other atmospheric contamination.

It may also be noted that an adjustable clamping device is arranged between the abutments 16 and 17 in order to protect suspension of the missiles which are rather heavy upon the launching device 4 against vibrations when the vehicle changes its position.

In the operation of the driving mechanism of the present invention, when the mechanism is in the position depicted in FIG. 2, the cover may be opened automatically by actuation of the lifting cylinder 24 in order to move the piston rod 26 upwardly, as viewed in FIG. 2. Upon actuation of the lifting cylinder 24, the reversing lever 27 pivots about its pivotal connection 29 rotating counter-clockwise in order to move the coupling rod 32 upwardly. Thus, the toggle lever joint 33 will be moved upwardly by movement of the coupling rod 32 thereby rotating the toggle lever 36 counter-clockwise about its pivot connection 34. The left end of the toggle lever 37 will be moved upwardly and leftwardly as viewed in FIG. 2 thereby causing the locking lever 39 to rotate clockwise about its pivotal connection 38. As a result, the abutment elements 42 and 43 become disengaged from the abutment elements 44 and 45 and the tension in the spring 55 will be reduced. During a further extension of the lifting cylinder 24, movement of the piston rod 26 will be transmitted through the aforementioned toggle joint to the locking plate 14, as seen in FIG. 3, and also to the cover 6 connected thereto. By operation of the lifting cylinder 24, the cover 6 may thus be rotated through an angle of 90° into the position **6*a* depicted in FIG. 2 whereby the cover will extend substantially vertically. It should be noted that the cover 6 remains locked upon the locking plate 14** since the eccentric screw mechanism has not been actuated.

With the cover in position **6*a*, the launching devices 4 may be loaded or charged with ammunition by operation of the loading devices 77.**

By reversing the operation of the lifting cylinder 24, the piston rod 26 will be moved downwardly as viewed in FIG. 2 and the cover 6 may thus be returned through operation of the toggle joint from its position **6*a* into the closed position depicted in FIG. 2. With the cover in a closed position, further movement thereof will be prevented by the packings 58. Accordingly, further retraction of the piston rod 26 will move the toggle lever joint 33 further downwardly while the cover remains fixed in the closed position. As a result, the toggle lever joint 33 will move past its dead center position below the line interconnecting the pivotal joints 34 and 38 and the levers 36 and 39 will be moved back into their respective locking positions to lock the cover 6** in place.

Where it is desired to recharge the magazine, the cover 6 must be moved into the position labelled 6*b*. With the cover in this position, it will extend substantially horizontally and flush with the upper opening of the magazine. As a result, the cover 6 may be utilized as a working platform during the charging of the magazine with missiles.

In order to effect this mode of operation, the slide 47 must be moved to the left as shown in FIG. 2 by operation of the eccentric screw device 50. As a result, the protuberance 48 will become disengaged from the pin 49 and the cover 6 may be detached from the locking plate 14. The disengaged position of the slide 47 is depicted as 54*a* in FIG. 2 and with the slide in this position the cover may be manually moved into the position 6*b*.

Inasmuch as the blocking plate 54 will now be in a position above the toggle lever joint 33, the locking plate 14 will be blocked from being accidentally or inadvertently moved upwardly by inadvertent actuation of the hydraulic mechanism. Furthermore, any pressure which may develop in the lifting cylinders as a result of blockage of the movement of the piston rod 26 will be reduced by overpressure valves (not shown). Thus, the present invention provides a safety feature during charging of the magazines.

After the magazine has been charged with missiles, the cover 6 may be rotated back into the position shown in FIG. 2 and it may be locked with the locking plate 14 by actuation of the eccentric screw device 15.

With the exception of the eccentric mechanism 50, which is accessible from the exterior of the magazine, and of the abutment member 16 and 17, all of the parts of the previously described driving mechanism will be arranged within the magazine itself and enclosed within the armor cover or outer wall 8 of the vehicle thereby being secured both against bombardment and against fouling.

While specific embodiments of the invention have been shown and described in detail to illustrate the application of the inventive principles, it will be understood that the invention may be embodied otherwise without department from such principles.

What is claimed is:

1. A driving mechanism for the cover of an ammunition magazine for an armored land vehicle including a launching device for said ammunition, means for loading said ammunition into said launching device from said magazine, and means pivotally mounting said cover on said vehicle, said driving mechanism comprising hydraulic driving means for pivotally driving said cover through an angle of about 90° between a generally horizontal closed position and a generally vertical position to open said magazine for loading of said ammunition from said magazine into said launching device, a mechanical locking device for releaseably locking said cover with said hydraulic driving means for enabling driving engagement therebetween, said locking device being releaseable to enable disengagement between said cover and said hydraulic driving means to permit manual pivotal movement of said cover through an angle of 180° to open said magazine for charging thereof with ammunition, said locking device including means for blocking movement of said hydraulic driving means when said locking device is released to disengage said cover from said hydraulic driving means.

2. A mechanism according to claim 1 wherein said magazine includes an upper opening lying in a generally horizontal plane, said means pivotally mounting said cover on said vehicle being arranged such that when said cover is rotated into its open position through 180°, said cover will extend in a generally horizontal direction within the plane of said magazine opening.

3. A mechanism according to claim 1, including a locking plate extending on the underside of said cover with said releaseable locking device operating to engage and disengage said cover from said locking plate, said hydraulic driving means including hydraulically actuated lifting cylinder means and piston rod means actuated by said cylinder means, said driving mechanism further including a spring loaded toggle joint assembly mounted on said locking plate and connected with said piston rod means to open and close said cover by actuation of said hydraulic cylinder means when said releasable locking device is in position to lock said cover with said locking plate.

4. A mechanism according to claim 3 wherein said toggle joint assembly comprises a pair of toggle levers each having one end pivotally connected to an end of the other of said levers to form a toggle lever joint with the opposite ends of each of said levers being pivotally joined to said locking plate, said mechanism further comprising a reversing rod having one end pivotally joined to said armored vehicle and an opposite end, said reversing rod being attached to said piston rod to be pivotally driven thereby about said one end, and a coupling rod extending between said toggle lever joint and said opposite end of said reversing rod to drive said toggle joint assembly upon actuation of said hydraulic driving means, and spring means biasing said toggle joint assembly in a direction tending to hold said cover locked in a closed position.

5. An assembly according to claim 4 wherein said mechanical locking device includes at slide member mounted on said locking plate for reciprocal movement between a first and a second position, an eccentric screw device for reciprocally moving said slide, latch means secured on said cover, means on said slide for engaging said latch means to lock said cover with said locking plate when said slide is in said first position and to unlock said cover from said locking plate when said slide is in said second position, and blocking means located on said slide to block movement of said toggle lever joint when said slide is in said second position.

6. A mechanism according to claim 5 wherein said toggle joint assembly further includes a locking lever having one end pivotally mounted to said locking plate and an opposite end pivotally joined to said opposite end of one of said pair of toggle levers, said spring means being engaged between said locking lever and said slide to bias said slide toward said first position.

7. A driving mechanism for opening and closing the cover of an ammunition magazine of an armored land vehicle comprising means pivotally mounting said cover to said vehicle to enable rotation thereof through an angle of at least 180° between a position closing said magazine and a plurality of positions opening said magazine, a locking plate positioned relative to said cover on a side thereof toward the inside of said magazine, a spring loaded toggle level assembly mounted on said locking plate operable between a locked position and an unlocked position, locking means adapted to be actuated between an a first position releaseably locking said cover with said locking plate and a second position disengaging said cover from said locking plate, hydraulic drive means for driving said toggle lever assembly between said locked and said unlocked positions, with operation of said hydraulic means when said locking means is in said first position operating to move said cover between a position closing said magazine and a position opening said magazine by rotation of said cover through an angle of about 90°, and means on said locking means for blocking movement of said toggle lever assembly by said hydraulic driving means when said locking means is in said second position, movement of said locking means to said second position operating to enable manual rotation of said cover about said pivotal mounting thereof between a position opening said magazine and a position closing said magazine by rotation of said cover through an angle of about 180°.

* * * * *